US010994288B2

(12) United States Patent
Cao et al.

(10) Patent No.: US 10,994,288 B2
(45) Date of Patent: May 4, 2021

(54) WATER OUTLET TERMINAL WITH PURIFIED WATER OUTLET

(71) Applicant: XIAMEN SOLEX HIGH-TECH INDUSTRIES CO., LTD., Fujian (CN)

(72) Inventors: Yongbin Cao, Fujian (CN); Mingnan Wang, Fujian (CN); Hao Shi, Fujian (CN); Quanbing Zhou, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 256 days.

(21) Appl. No.: 15/964,749

(22) Filed: Apr. 27, 2018

(65) Prior Publication Data

US 2018/0318849 A1 Nov. 8, 2018

(30) Foreign Application Priority Data

May 8, 2017 (CN) ..... 201710317591.9

(51) Int. Cl.
*B05B 1/16* (2006.01)
*E03C 1/04* (2006.01)

(52) U.S. Cl.
CPC ..... *B05B 1/169* (2013.01); *E03C 1/04* (2013.01); *E03C 1/0404* (2013.01); *E03C 1/0405* (2013.01); *E03C 2001/0415* (2013.01); *E03C 2201/30* (2013.01)

(58) Field of Classification Search
CPC ..... F16K 11/00; F16K 11/04; F16K 11/044; F16K 11/0445; F16K 11/06; B05B 1/169; E03C 1/04; E03C 1/0404; E03C 1/0405; E03C 2001/0415; E03C 2201/30
USPC ..... 239/401, 443, 444, 570
See application file for complete search history.

(56) References Cited

U.S. PATENT DOCUMENTS 2,554,417 A * 5/1951 Morrison ..... F25D 31/002 62/319
4,107,046 A * 8/1978 Corder ..... B01D 35/043 210/282
4,193,553 A * 3/1980 Kelly ..... B05B 1/3013 239/525
5,383,604 A * 1/1995 Boesch ..... B05B 1/1618 239/447
5,653,260 A * 8/1997 Huber ..... E03C 1/021 137/625.33
5,772,120 A * 6/1998 Huber ..... B05B 1/1618 239/391

(Continued)

*Primary Examiner* — Viet Le
(74) *Attorney, Agent, or Firm* — Cooper Legal Group, LLC

(57) ABSTRACT

A water outlet terminal with the function of purified water outlet, includes a body and a mandrel. A raw water outlet hole and a pure water outlet hole are arranged on the end surface of the mandrel. The mandrel has a raw water inlet cavity and a purified water inlet cavity which are independent from each other. One end of the raw water inlet cavity and the purified water inlet cavity are communicated with the raw water outlet hole and the purified water outlet hole, and the other ends are the raw water inlet hole and the purified water inlet hole. The water outlet terminal has a purified water opening member with a first position and a second position corresponding to an open or closed state of purified water inlet hole, a cover assembly, with a purified water outlet passage in the geometric center of the assembly.

20 Claims, 14 Drawing Sheets

(56) References Cited

U.S. PATENT DOCUMENTS 6,003,170 A * 12/1999 Humpert ..... E03C 1/057 251/129.03
6,016,836 A * 1/2000 Brunkhardt ..... E03C 1/08 137/624.11
6,093,313 A * 7/2000 Bovaird ..... B01D 35/04 137/551
6,145,757 A * 11/2000 Knapp ..... B05B 1/1609 239/443
6,219,860 B1 * 4/2001 Chang ..... E03C 1/0404 137/801
6,517,720 B1 * 2/2003 Aldred ..... B01D 35/04 137/545
6,641,727 B1 * 11/2003 Aldred ..... B01D 35/04 210/232
6,941,971 B1 * 9/2005 Hsien ..... 137/801
7,341,239 B2 * 3/2008 Hodel ..... F16K 31/52416 137/872
7,607,588 B2 * 10/2009 Nobili ..... B05B 1/1618 137/613
8,136,552 B2 * 3/2012 Carignan ..... F16K 21/04 137/625.4
8,322,377 B2 * 12/2012 Di Nunzio ..... F16K 11/078 137/636.3
8,448,667 B2 * 5/2013 Meehan ..... E03C 1/0404 137/637.1
8,573,512 B2 * 11/2013 Hu ..... B05B 1/1663 239/443
9,387,495 B2 * 7/2016 Schumacher ..... B05B 1/3013
9,707,572 B2 * 7/2017 Erickson ..... B05B 1/1627
9,772,040 B2 * 9/2017 Liu ..... F16K 11/0787
10,329,750 B2 * 6/2019 Yuan ..... F16K 31/52491
10,443,218 B2 * 10/2019 Yuan ..... B05B 1/02
2004/0227014 A1 * 11/2004 Williams ..... B05B 1/1618 239/443
2005/0121542 A1 * 6/2005 Su Lim ..... A47K 13/00 239/525
2005/0161533 A1 * 7/2005 Nobili ..... E03C 1/0409 239/447
2005/0189438 A1 * 9/2005 Bosio ..... B05B 1/1618 239/443
2006/0266424 A1 * 11/2006 Filtness ..... E03C 1/0403 137/625.4
2007/0018019 A1 * 1/2007 Nobili ..... B05B 12/004 239/581.1
2007/0044850 A1 * 3/2007 Pieters ..... F16K 11/0787 137/597
2007/0194148 A1 * 8/2007 Rosko ..... B05B 1/1609 239/526
2007/0246550 A1 * 10/2007 Rodenbeck ..... G05D 23/1393 236/12.11
2008/0067264 A1 * 3/2008 Erickson ..... B05B 1/1618 239/445
2008/0105764 A1 * 5/2008 Jianglin ..... B05B 1/1618 239/526
2008/0245897 A1 * 10/2008 Nobili ..... E03C 1/0409 239/407
2009/0242058 A1 * 10/2009 Hansen ..... E03C 1/0403 137/801
2010/0006169 A1 * 1/2010 Bolgar ..... F16K 11/0743 137/898
2010/0139798 A1 * 6/2010 Schooley, Jr. ..... B05B 1/18 137/893
2012/0018020 A1 * 1/2012 Moore ..... E03C 1/0403 137/798
2012/0267455 A1 * 10/2012 Hansen ..... B05B 1/18 239/547
2012/0312401 A1 * 12/2012 Gioira ..... F16L 41/023 137/603
2013/0193237 A1 * 8/2013 Erickson ..... E03C 1/084 239/548
2014/0069520 A1 * 3/2014 Esche ..... E03C 1/0404 137/315.01
2015/0068968 A1 * 3/2015 Chiu ..... B01D 61/20 210/295
2016/0136659 A1 * 5/2016 Erickson ..... B05B 1/1618 239/443
2019/0003165 A1 * 1/2019 Huang ..... E03C 1/2304

* cited by examiner

WATER OUTLET TERMINAL WITH PURIFIED WATER OUTLET

TECHNICAL FIELD

The present invention relates to a water outlet device, and more particularly to a water outlet device having two water outlet modes of raw water and purified water.

BACKGROUND TECHNIQUE

In the prior art, the pull-type faucet used in the kitchen needs to set complex waterway structure in the pull-type faucet if the two water outlet modes of purified water and raw water are to be realized, and the purified water switch and the raw water switch are also designed on the faucet at the same time. When the purified water switch is turned on, the user needs to turn off the raw water switch, otherwise, the raw water and the purified water may be discharged at the same time. Therefore, in the prior art, the purified water switch and the raw water switch are designed in linkage. When the purified water switch is turned on, the raw water switch is automatically turned off. This structure is very complicated. In addition, in the prior art, the purified water cavity and the raw water cavity are disposed on both sides of the mandrel, respectively, and the thickness of the mandrel is limited. Therefore, the volumes of the two water cavities also become smaller. In this way, the flow in the water cavity becomes smaller. When the water pressure is low, the water flow in the water cavity is also relatively small, which is likely to cause the water outlet flow at the water outlet terminal to be small and the water outlet stability at the end of the water outlet terminal to be relatively worse.

Content of the Invention

The main technical problem to be solved by the present invention is to provide a water outlet terminal which has two water outlet modes of raw water and purified water, and the switching structure of raw water and purified water is simple.

In order to solve the above technical problem, the present invention provides a water outlet terminal with the function of purified water outlet, comprising a body and a mandrel disposed in the body, an end surface of the mandrel is provided with a raw water outlet hole and a purified water outlet hole;

the mandrel is provided on the same side with a raw water inlet cavity and a purified water inlet cavity which are independent of each other; one end of the raw water inlet cavity and the purified water inlet cavity is communicated with the raw water outlet hole and the purified water outlet hole, and the other end is a raw water inlet hole and a purified water inlet hole; the water outlet terminal is further provided with a purified water opening member which is switched between a first position and a second position so that the purified water inlet hole in the open state or close state;

further comprising a cover assembly, wherein a water outlet passage is provided in the geometric center of the cover assembly for communication with the fluid in the water inlet cavity.

In a preferred embodiment: the raw water inlet cavity and the purified water inlet cavity are provided with an open end along the water flow direction on the same side, the rest of the raw water inlet cavity and purified water inlet cavity is sealing portion, the periphery of the open end is welded to a weld tab to seal the open end.

In a preferred embodiment: the side of the purified water inlet cavity away from the raw water inlet cavity is further provided with a second open end, and the second open end is welded and sealed with the second weld tab.

In a preferred embodiment: the raw water inlet hole is always in a normally open state.

In a preferred embodiment: the raw water outlet hole comprises at least two water outlet holes with different outlet forms.

In a preferred embodiment: the raw water outlet hole comprises a first water outlet hole and a second water outlet hole; the second water outlet hole is arranged on the periphery of the first water outlet the hole and concentric with the first water outlet hole.

In a preferred embodiment: the purified water outlet is arranged at the center of the first water outlet hole.

In a preferred embodiment: the first water outlet hole is a bubble water outlet, and a aerator is arranged at the bubble water outlet hole.

In a preferred embodiment: a raw water switching member for switching the water outlet water form of the raw water; and when the raw water switching member is operated, one of the first water outlet hole and the second water outlet hole is in an open state and the other is in a sealed state.

In a preferred embodiment: the side of the mandrel facing away from the raw water inlet cavity and the purified water inlet cavity is provided with a first installation hole for installing the raw water switching member;

the raw water switching member comprises a key and a first switching shaft; the first switching shaft is disposed between the raw water inlet cavity and the raw water outlet hole through the first installation hole; the key is connected with a fulcrum, the two ends of the key are pressing ends, one of the pressing ends is interlocked with an end of the first switching shaft exposed outside the first installation hole so as to drive the first switching shaft to move so that one of the first water outlet hole and the second water outlet hole is communicated with the raw water inlet cavity, the other end is sealed from the raw water inlet cavity.

In a preferred embodiment: the purified water opening member is one of a mechanical switch, a touch switch and a remote control switch.

In a preferred embodiment: the mandrel is further provided with a second installation holes on the same side with the first installation hole;

the purified water opening member comprises a button and a second switching shaft; the second switching shaft is disposed between the purified water inlet hole and the purified water inlet cavity through the second installation hole; the button is arranged in linkage with the second switching shaft through a ball-point pen mechanism; and pressing the button drives the second switching shaft to switch between the first position and the second position; the outer periphery of the second switching shaft is provided with a first sealing rings and a second sealing ring arranged coaxially with the second switching shaft and the areas of the first sealing ring and the second sealing ring are the same; when the purified water opening member is in the second position, the first sealing ring and the second sealing ring are respectively located in both sides of the purified water inlet hole and close the purified water inlet hole.

In a preferred embodiment: a flexible water inlet pipe; the water inlet pipe comprises a raw water inlet pipe and a purified water inlet pipe which are coaxially nested and are respectively communicated with the raw water inlet hole and the purified water inlet hole.

In a preferred embodiment: a raw water opening member separately provided from the water outlet terminal, the raw water opening member controls the water flow in the raw water inlet pipe to open or close; so that the raw water opening member and the purified water opening member are independent from each other.

In a preferred embodiment: a three-way valve; the three-way valve is provided with a raw water interface and a water purifying interface, and which are provided with the raw water introducing cavity and the purified water introducing cavity independent of each other; both ends of the raw water introducing cavity are respectively connected with the raw water interface and the raw water inlet pipe; both ends of the purified water introducing cavity are respectively connected with the purified water interface and the purified water inlet pipe.

Compared with the prior art, the present invention has the following beneficial effects:

1. The invention provides a water outlet terminal with the function of purified water outlet, which has two water outlet modes of raw water and purified water. And the raw water switch and purified water switch are independent of each other, the raw water waterway keep normally open, only after the faucet water inlet switch is closed, the raw water waterway can be closed. The purified water open member is set in the water terminal. The user can operate the purified water open member to open and close the purified water waterway, which has nothing to do with the switching of the raw water waterway, thus achieving the separation of the two waterway operations. Users are not prone to misuse during use.

2. The present invention provides a water outlet terminal with a function of purified water outlet. The raw water outlet hole and the purified water outlet hole are coaxially arranged, so that the raw water inlet cavity and the purified water inlet cavity are arranged on the same side of the mandrel; therefore, the open ends of the raw water inlet cavity and the purified water inlet cavity along the water flow direction are also on the same side, so that the open end can be sealed by using a weld tab after the mandrel is formed. However, in the traditional mandrel, the open ends of the raw water cavity and the purified water cavity are respectively arranged on two sides of the mandrel, that is, two pieces of weld tabs are required to be welded. Therefore, the technical solution of the present invention has a simpler structure, fewer parts and less processing requirements.

3. The present invention provides a water outlet terminal with the function of purified water outlet. The structure of the mandrel maximizes the space of the raw water inlet cavity and the purified water inlet cavity, which is favorable for increasing the flow rate of the water outlet. If the raw water inlet cavity and the purified water inlet cavity are set on both sides of the mandrel, it will cause the waterway to be complex, the water space to become smaller, resulting in increased tube resistance, the water flow at the water outlet terminal will be reduced when the water pressure is low, lower the use stability of the water outlet terminal.

4. The invention provides a water outlet terminal with the function of purified water outlet, which adopts the structure of the pipe in the pipe and realizes both the raw water inlet and the purified water inlet.

5. The present invention provides a water outlet terminal with the function of purified water outlet, and also has a raw water switching member, so that the raw water outlet water can be switched in the shower water or the bubble water through the raw water switching member, further increasing the function of the water outlet terminal.

6. The present invention provides a water outlet terminal with the function of purified water outlet, and the purified water outlet hole is arranged at the center of the water outlet surface without occupying the position of the raw water outlet. As a result, the water outlet holes are concentrically arranged, the overall appearance is beautiful, the shape of the raw water outlet is also relatively complete, avoiding the occupation of the purified water outlet hole and making the relative incompleteness of the outlet water form.

DETAILED DESCRIPTION

Figure 1:
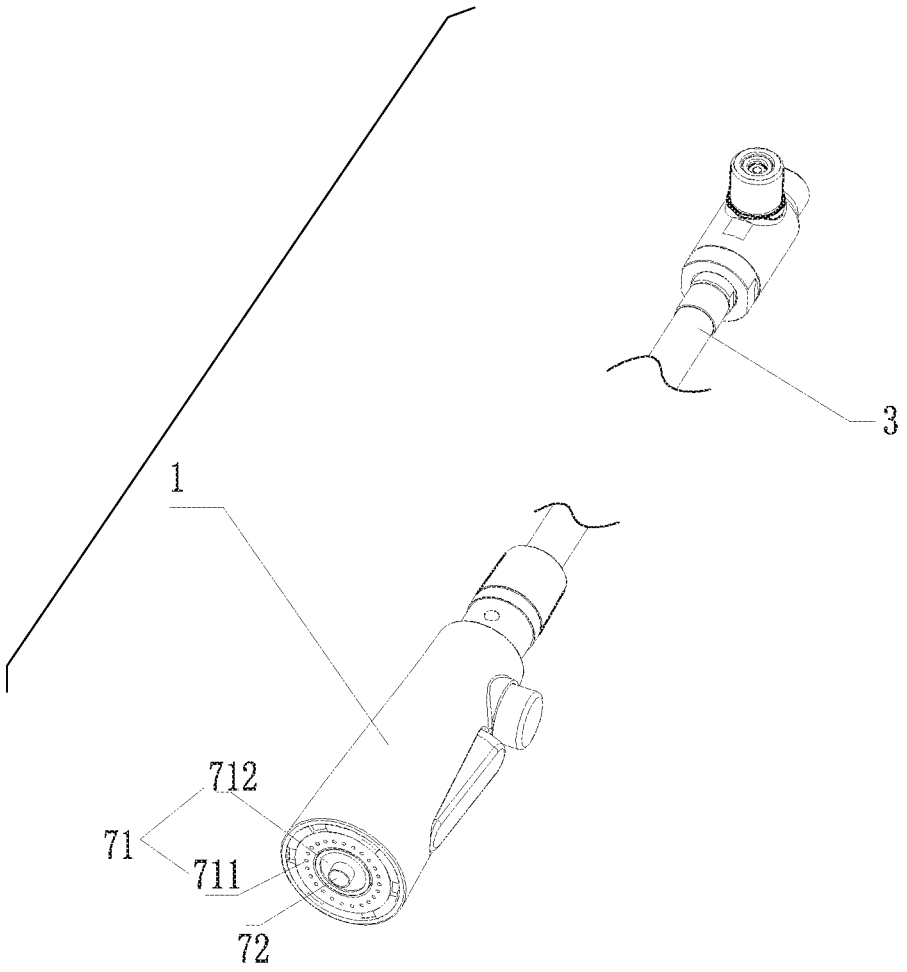
FIG. 1 is a perspective view of a water outlet terminal according to a preferred embodiment of the present invention.
Figure 2:
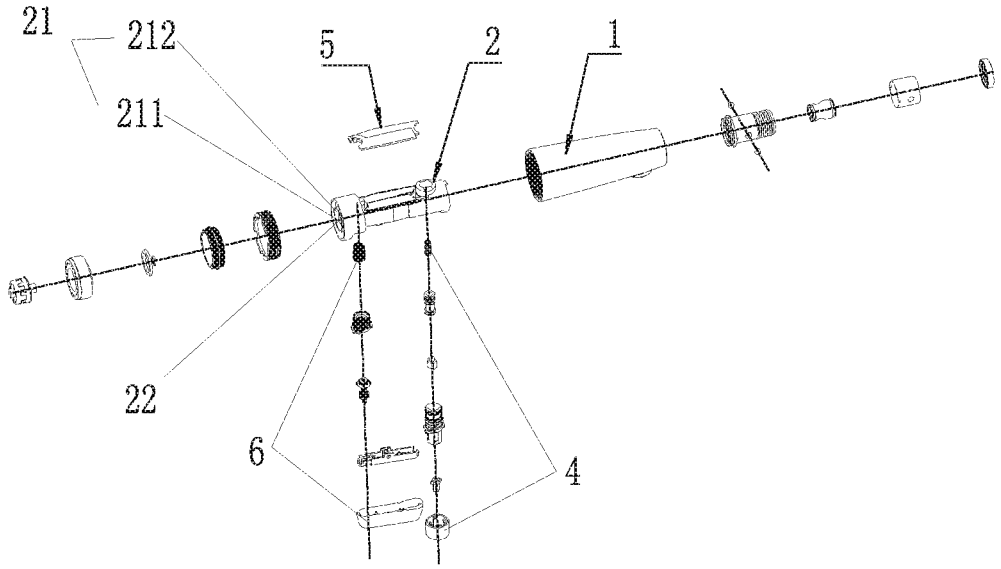
FIG. 2 is a structural exploded view of the core components of the water outlet terminal according to a preferred embodiment of the present invention.
Figure 3:
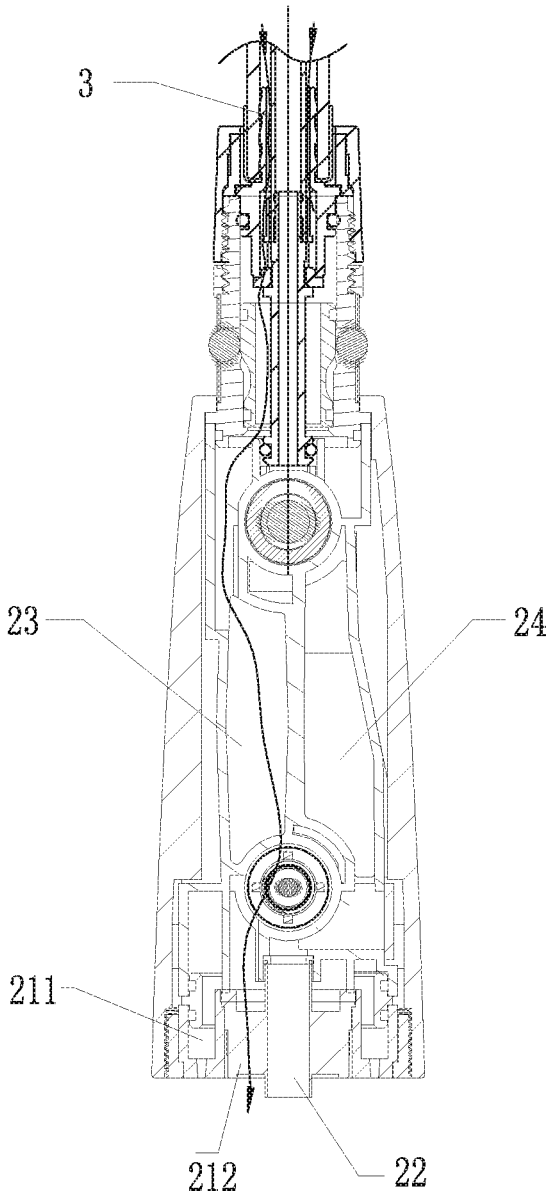
FIG. 3 is a waterway diagram of the water outlet terminal when discharging raw water according to a preferred embodiment of the present invention.
Figure 4:
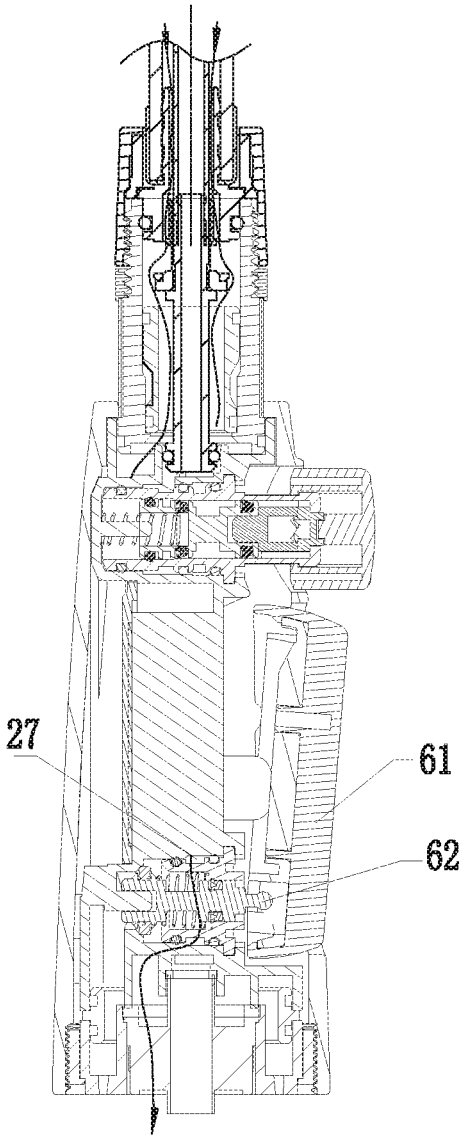
FIG. 4 is a schematic diagram of the internal structure of the water outlet terminal when discharge raw water according to a preferred embodiment of the present invention.
Figure 5:
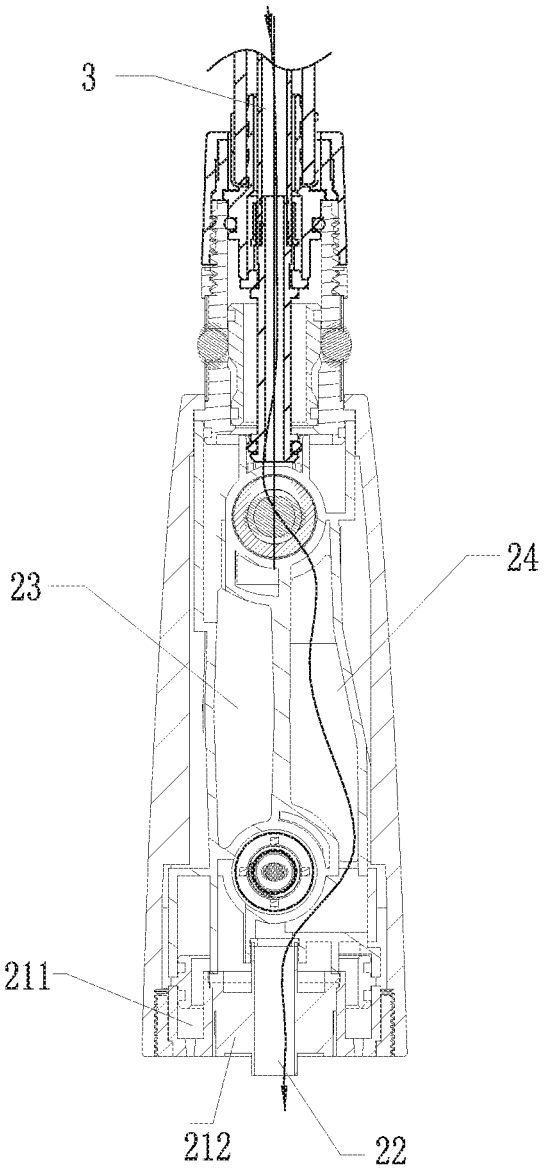
FIG. 5 is a schematic view of the waterway of the water outlet terminal when discharging purified water according to a preferred embodiment of the present invention.
Figure 6:
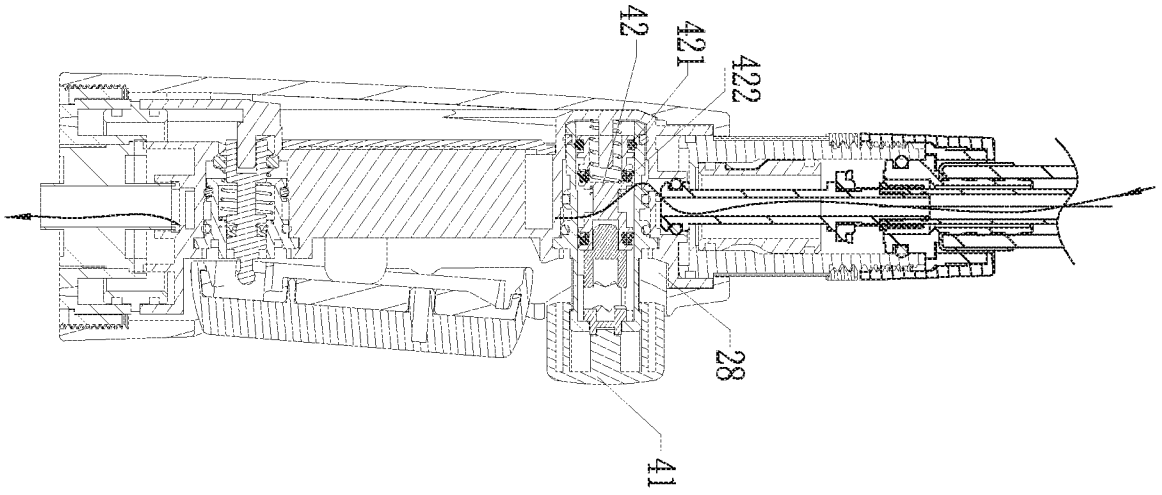
FIG. 6 is a schematic diagram of the internal structure of the water outlet terminal when discharging purified water according to a preferred embodiment of the present invention.
Figure 7:
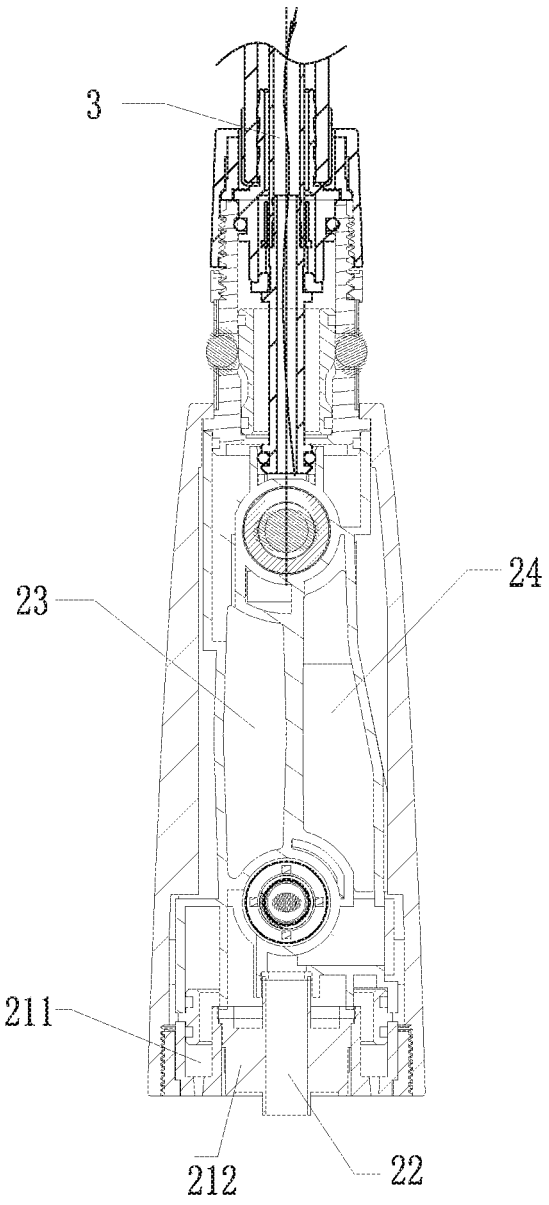
FIG. 7 is a waterway diagram of the outlet terminal when purified water is closed according to a preferred embodiment of the present invention.
Figure 8:
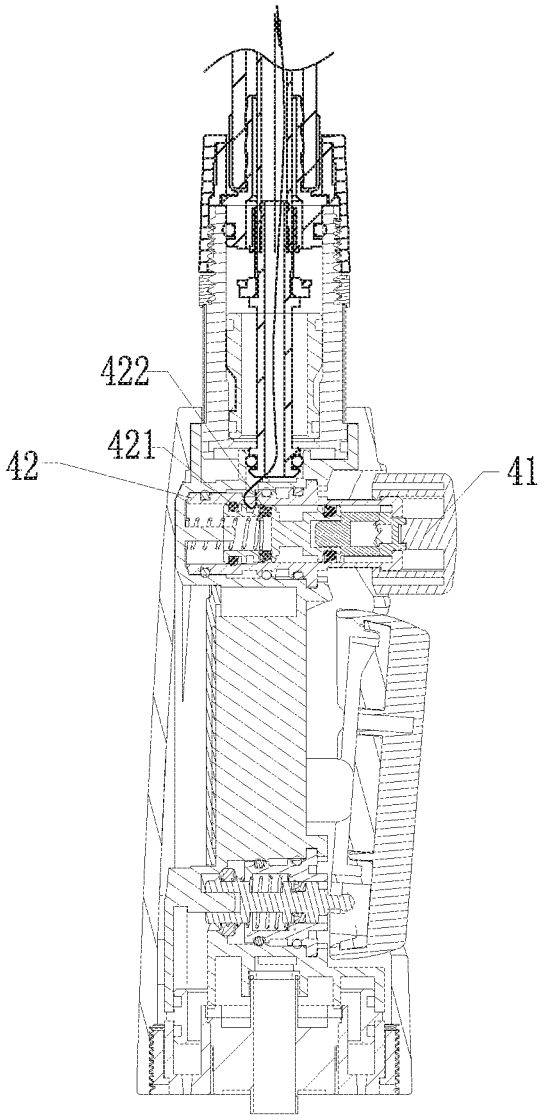
FIG. 8 is a schematic diagram of the internal structure of the outlet terminal when the purified water is closed according to a preferred embodiment of the present invention.
Figure 9:
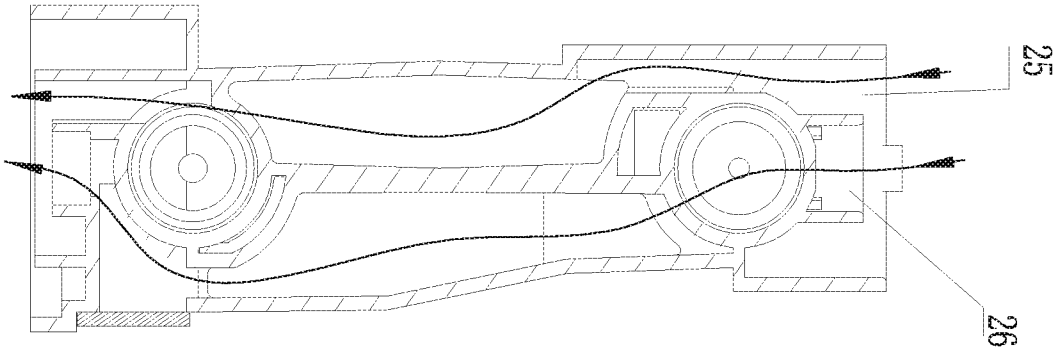
FIG. 9 is a waterway diagram of the mandrel according to a preferred embodiment of the present invention.
Figure 10:
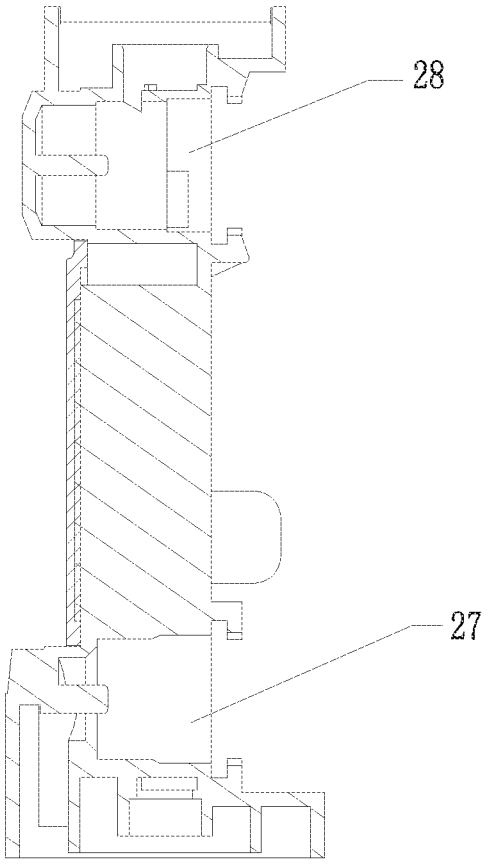
FIG. 10 is a cross-sectional view of the mandrel according to a preferred embodiment of the present invention.
Figure 11:
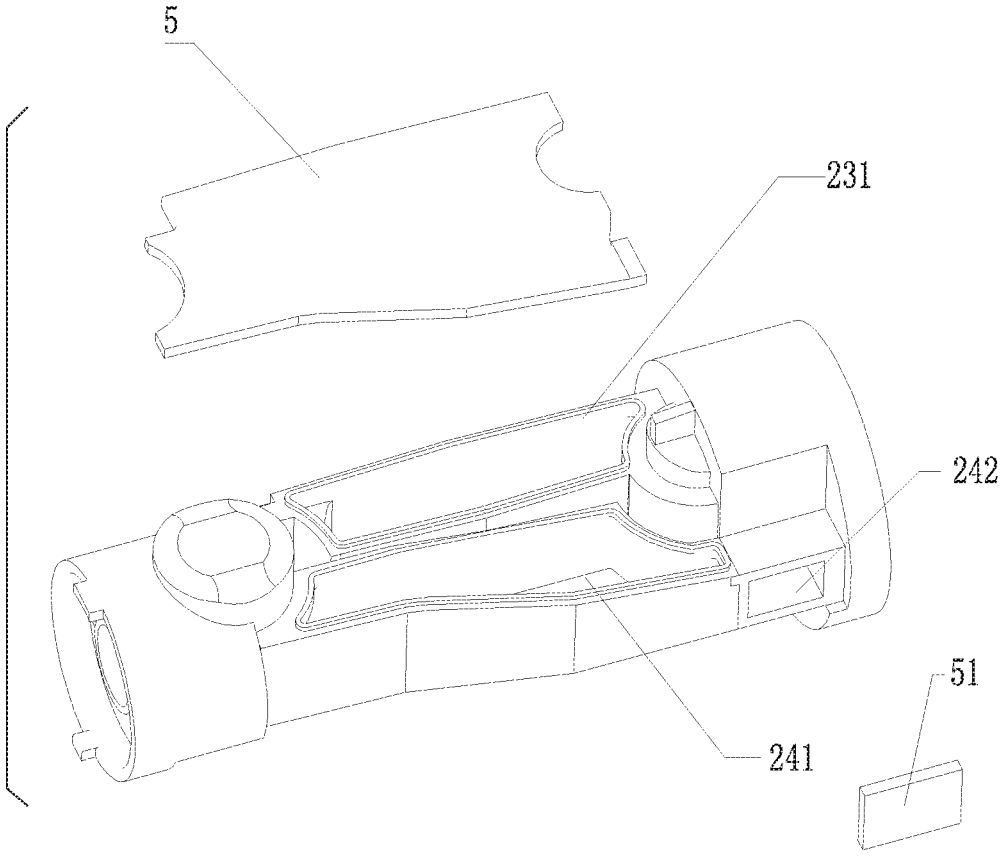
FIG. 11 is a schematic view of a welding sealing of the mandrel according to a preferred embodiment of the present invention.

The technical solutions of the present invention are further described below with reference to the accompanying drawings and specific embodiments.

Referring to 1-11, a water outlet terminal with the function of purified water outlet includes a body 1 and a mandrel 2 disposed in the body 1. The end surface of the mandrel 2 is coaxially provided with a raw water outlet hole 21 and a purified water outlet Hole 22;

The mandrel 2 is provided with a raw water inlet cavity 23 and a purified water inlet cavity 24 on the same side; one end of the raw water inlet cavity 23 and the purified water inlet cavity 24 communicate with the raw water outlet hole 21 and the purified water outlet hole 22, the other end is the raw water inlet hole 25 and the purified water inlet hole 26;

Further comprising a water inlet pipe 3, the water inlet pipe 3 comprises a raw water inlet pipe and a purified water inlet pipe nested in a coaxial manner, and respectively communicated with the raw water inlet hole 25 and the purified water inlet hole 26. Wherein the raw water inlet hole 25 is always in communication with the raw water inlet pipe; and a purified water opening member 4 is disposed between the purified water inlet hole 26 and the purified water inlet cavity 24, and the purified water opening member 4 is switching between the first position and the second position, so that the purified water inlet hole 26 and the purified water inlet cavity 24 are in an open communication state or an isolated closed state.

In this embodiment, the water outlet terminal is a kitchen pull-out faucet, which is merely an example in this embodiment. Those skilled in the art may apply the above structure to other water outlet terminals, which is a simple replacement of the present embodiment.

Therefore, one of the above water outlet terminals with the function of purified water outlet has two water outlet modes of raw water and purified water. And, because the raw water waterway remains normally open, you can turn off the faucet water inlet switch to close the raw water waterway. While the purified water open member 4 of the purified water is set in the water outlet terminal. The user can operate the purified water open member to open and close the purified water waterway, which has nothing to do with the switching of the raw water waterway, thus achieving the separation of the two waterway operations. Users are not prone to misuse during use.

At the same time, since the raw water outlet hole 21 and the purified water outlet hole 22 are coaxially arranged, the raw water inlet cavity 23 and the purified water inlet cavity 24 may be disposed on the same side of the mandrel 2. Therefore, the open ends 231 and 241 of the raw water inlet cavity 23 and the purified water inlet cavity 24 along the water flow direction are also on the same side, in this way, the mandrel 2 can seal the open ends 231, 241 with only one weld tab 5 after the molding. However, in the traditional mandrel, the open ends of the raw water cavity and the purified water cavity are respectively arranged on two sides of the mandrel, that is, two pieces of welding pieces are required to be welded. Therefore, the above technical solution is simpler in structure, less in parts and less in processing requirements.

Moreover, the above structure of the mandrel 2 maximizes the space of the raw water inlet cavity 23 and the purified water inlet cavity 24, which is favorable for increasing the flow rate of the water outlet. If the raw water inlet cavity and the purified water inlet cavity are set on both sides of the mandrel, it will cause the waterway to be complex, and the water space to become smaller, resulting in increased tube resistance, the water flow at the water outlet terminal will be reduced when the water pressure is lower, lower the use stability of the water outlet terminal.

The side of the purified water inlet cavity 24 away from the raw water inlet cavity 23 is further provided with a second open end 242, and through the second open end 242 the mandrel corresponds to part of the core, thereby forming a water passage cavity extending in a direction substantially perpendicular to the longitudinal direction of the mandrel. The second open end 242 is welded and sealed with the second weld tab 51, so that the purified water can finally be discharged from the center of the mandrel.

In addition, in order to further increase the function of the pull-out faucet, the raw water outlet hole 21 includes at least two water outlet holes with different outlet forms. In this embodiment, the raw water outlet hole 21 includes a shower water outlet hole 211 and a bubble water outlet hole 212. The shower water outlet hole 211 is disposed on the outer periphery of the bubble water outlet hole 212 and concentrically arranged with the bubble water outlet hole 212. According to other needs, raw water is not limited to the shape of water shower and bubble water above, you can also set the other forms of water. As long as there are two different forms of the water outlet effect, it is within the scope of the present invention.

The purified water outlet hole 22 is disposed at the center of the bubble water outlet hole 212. The end of the mandrel is fixedly connected with a cover assembly 7, and comprises a hollow water outlet cover and a double channel aerator. The shower water outlet hole 211, the bubble water outlet hole 212 and the purified water outlet hole 22 are respectively connected with the water outlet cover 711, the outer channel 712 of the double channel aerator, the inner channel 72 of the double channel aerator. Therefore, the purified water flows out of the inner channel of the double channel aerator, and the raw water flow through the outer channel of the aerator forms bubble water outlet, and the water that does not flow through the aerator forms a normal shower water.

In order to facilitate the user to switch between the two raw water outlet forms, a raw water switch member 6 for switching the raw water outlet form is also included; when the raw water switch member 6 is operated, one of the shower water outlet hole 211 and the bubble water outlet hole 212 is open and the other is sealed. In order to achieve the water flow switching conveniently.

The specific structure is as follows: the side of the mandrel 2 facing away from the raw water inlet cavity 23 and the purified water inlet cavity 24 is provided with a first installation hole 27 for installing the raw water switching member 6; The raw water switching member 6 includes a key 61 and a first switching shaft 62; the first switching shaft 62 is disposed between the raw water inlet cavity 23 and the raw water outlet hole 21 through the first installation hole 27; the key 61 is connected to a fulcrum. The two ends of the key 61 is pressing ends. One of the pressing ends is disposed in conjunction with the end of the first switching shaft 62 exposed outside the first installation hole 27 so as to drive the first switching shaft 62 to move, and then one of the shower water outlet hole 211 and the bubble water outlet hole 212 is communicated with the raw water inlet cavity 23 and the other is sealed and separated from the raw water inlet cavity 23.

In this embodiment, the mandrel 2 is further provided with a second installation hole 28 for installing the purified water open member 4 on the same side as the first installation hole 27;

The purified water opening member 4 includes a button 41 and a second switching shaft 42; the second switching shaft 42 is disposed between the purified water inlet hole 26 and the purified water inlet cavity 24 through the second installation hole 28; The button 41 is interlocked with the second switching shaft 42 via a ball-point pen mechanism. Pressing the button 41 drives the second switching shaft 42 to cycle switch between the first position and the second position. the outer periphery of the second switching shaft 42 is provided with two first sealing ring 421 and second sealing ring 422 coaxially with the second switching shaft 42; and the areas of the first sealing ring 421 and the second sealing ring 422 are the same; and when the purified water opening member 4 is in the second position, the first sealing ring 421 and the second sealing ring 422 are respectively located at two sides of the purified water inlet hole 26 to close the purified water opening member 4. Since the areas of the first sealing ring 421 and the second sealing ring 422 are the same, when in the second position, the water pressures received by the first sealing ring 421 and the second sealing ring 422 are equal to each other in magnitude and opposite in direction. Therefore, the user presses the button 41 to switch from the second position to the first position, only the elastic force of the spring in the ball-point pen mechanism needs to be overcome, the switching force is relatively small, and the switching feel is good.

Figure 12:
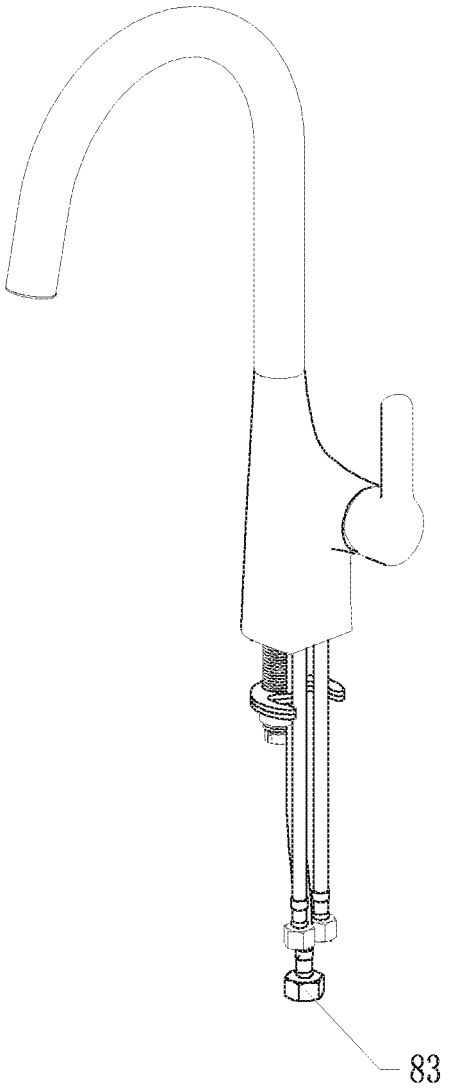
FIG. 12 is a schematic view of a traditional kitchen pullout faucet after taking out the water outlet shower and the water inlet hose.
Figure 13:
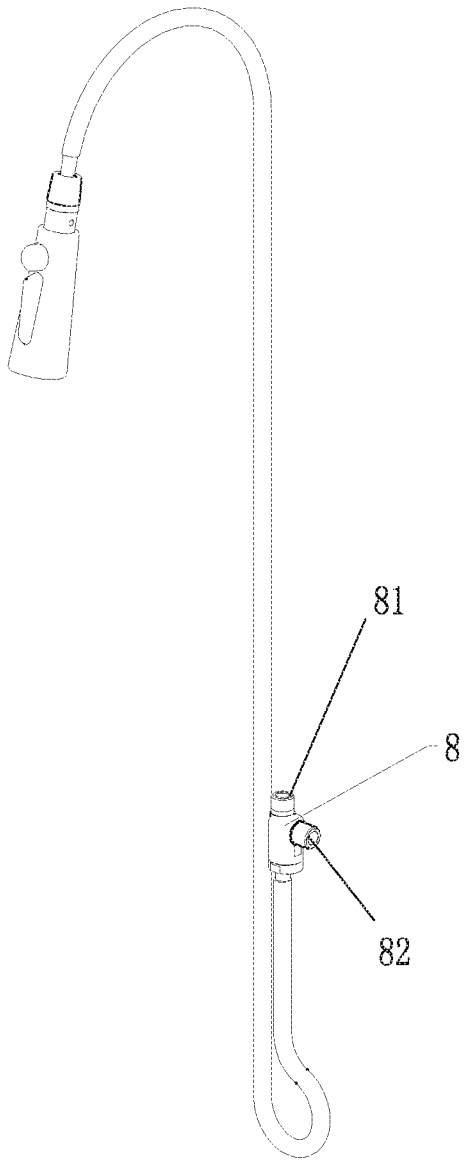
FIG. 13 is another perspective view of the water outlet terminal according to a preferred embodiment of the present invention.
Figure 14:
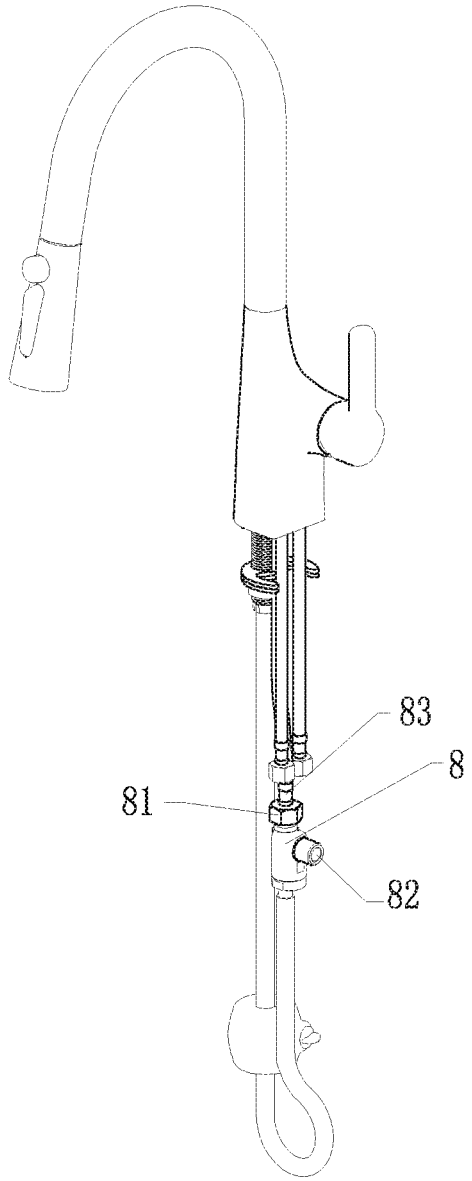
FIG. 14 is a schematic diagram of the combination of the FIG. 12 and the FIG. 13.

Referring to FIG. 12-14, in this embodiment, the water outlet terminal also includes a three-way valve 8; the three-way valve 8 is provided with a raw water interface 81 and a purified water interface 82, and is provided therein with a raw water introducing cavity and a purified water introducing cavity independent of each other. The two ends of the raw water introducing cavity are respectively connected with the raw water interface and the raw water inlet pipe, and both ends of the purified water introducing cavity are respectively connected with the purified water interface and the purified water inlet pipe. The raw water interface 81 may be connected to the faucet mixed water outlet end 83, and the purified water interface 82 may be connected to the water outlet end of the water purifier. And because the raw water open member is the faucet water inlet switch. Therefore only need to replace the outlet water faucet and the water inlet hose of the existing pull-out faucet with the water outlet terminal of the present invention to complete the conversion of ordinary faucet to the faucet with purified water and raw water. Therefore, the versatility of the present invention is relatively strong and convenient to replace.

The foregoing descriptions are merely preferred embodiments of the present invention, but the design concept of the present invention is not limited thereto. Anyone skilled in the art may use the concept to perform the present invention within the technical scope disclosed in the present invention. Any non-substantive changes are those that violate the protection scope of the present invention.

The invention claimed is:

1. A water outlet terminal with a purified water outlet, comprising:
- a body,
- a mandrel disposed in the body,
- a purified water opening member, and
- a cover assembly, wherein:
  - an end surface of the mandrel comprises a raw water outlet hole and a purified water outlet hole,
  - a first side of the mandrel comprises a raw water inlet cavity and a purified water inlet cavity being independent from each other,
  - a first end of the raw water inlet cavity and a first end of the purified water inlet cavity are respectively in communication with the raw water outlet hole and the purified water outlet hole,
  - a second end of the raw water inlet cavity and a second end of the purified water inlet cavity respectively define a raw water inlet hole and a purified water inlet hole,
  - the purified water opening member is configured to be switched between a first position and a second position to enable the purified water inlet hole to be in an open state or a closed state,
  - a water outlet passage at a geometric center of the cover assembly is in fluid communication with the purified water inlet cavity,
  - the mandrel defines a first opening at a first side of the raw water inlet cavity and a second opening at a first side of the purified water inlet cavity respectively extending along a direction of flowing water,
  - at least one of:
    - the first opening at the first side of the raw water inlet cavity extends a length of the raw water inlet cavity in the direction of flowing water, or
    - the second opening at the first side of the purified water inlet cavity extends a length of the purified water inlet cavity in the direction of flowing water,
  - the first opening and the second opening are configured to be covered by a tab, and
  - the first side of the raw water inlet cavity and the first side of the purified water inlet cavity are on a same side of the mandrel.

2. The water outlet terminal with the purified water outlet according to claim 1, wherein:
- a remainder of the raw water inlet cavity and a remainder of the purified water inlet cavity are sealed portions, and
- peripheries of the first opening and the second opening are welded to the tab to seal the first opening and the second opening.

3. The water outlet terminal with the purified water outlet according to claim 2, wherein:
- a second side of the purified water inlet cavity away from the raw water inlet cavity comprises an open end, and
- the open end is sealed to a second tab by welding.

4. The water outlet terminal with the purified water outlet according to claim 2, wherein the raw water inlet hole is always in an open state.

5. The water outlet terminal with the purified water outlet according to claim 4, wherein the raw water outlet hole comprises at least two water outlet holes with different outlet forms.

6. The water outlet terminal with the purified water outlet according to claim 5, wherein:
- the at least two water outlet holes comprise a first water outlet hole and a second water outlet hole,
- the second water outlet hole is disposed on a periphery of the first water outlet hole, and
- the first water outlet hole and the second water outlet hole are concentric.

7. The water outlet terminal with the purified water outlet according to claim 6, wherein the purified water outlet hole is disposed at a center of the first water outlet hole.

8. The water outlet terminal with the purified water outlet according to claim 7, wherein:
- the first water outlet hole is a bubble water outlet, and
- an aerator is disposed on the bubble water outlet.

9. The water outlet terminal with the purified water outlet according to claim 7, comprising:
- a raw water switching member for switching between the first water outlet hole and the second water outlet hole, wherein:
  - when the raw water switching member is operated, one of the first water outlet hole or the second water outlet hole is in an open state and the other of the first water outlet hole or the second water outlet hole is in a closed state.

10. The water outlet terminal with the purified water outlet according to claim 9, wherein:

a second side of the mandrel away from the raw water inlet cavity and the purified water inlet cavity comprises a first installation hole for installing the raw water switching member, the raw water switching member comprises a key and a first switching shaft, the first switching shaft is disposed between the raw water inlet cavity and the raw water outlet hole through the first installation hole, the key is connected with a fulcrum, two ends of the key are pressing ends, a first one of the pressing ends is operatively connected to an end of the first switching shaft exposed outside of the first installation hole to drive the first switching shaft to move to enable one of the first water outlet hole or the second water outlet hole to be in communication with the raw water inlet cavity, and the other of the first water outlet hole or the second water outlet hole is sealed from the raw water inlet cavity.

11. The water outlet terminal with the purified water outlet according to claim 10, wherein the purified water opening member is a mechanical switch, a touch switch, or a remote control switch.

12. The water outlet terminal with the purified water outlet according to claim 10, wherein:

the mandrel further comprises a second installation hole disposed on the same side of the mandrel as the first installation hole, the purified water opening member comprises a button and a second switching shaft, the second switching shaft is disposed between the purified water inlet hole and the purified water inlet cavity through the second installation hole, the button is operatively connected to the second switching shaft through a connecting mechanism, the button is pressed to drive the second switching shaft to switch between a first position and a second position, an outer periphery of the second switching shaft is disposed with a first sealing ring and a second sealing ring disposed coaxially with the second switching shaft, an area of the first sealing ring is the same as an area of the second sealing ring, when the purified water opening member is in the second position, the first sealing ring and the second sealing ring are respectively disposed on opposite sides of the purified water inlet hole and close the purified water inlet hole, and when the purified water opening member is in the first position, the purified water inlet hole is in the open state.

13. The water outlet terminal with the purified water outlet according to claim 1, comprising:

a water inlet pipe, wherein:

the water inlet pipe comprises a raw water inlet pipe and a purified water inlet pipe coaxially disposed with the raw water inlet pipe, and the raw water inlet pipe and the purified water inlet pipe are respectively in communication with the raw water inlet hole and the purified water inlet hole.

14. The water outlet terminal with the purified water outlet according to claim 13, wherein:

a raw water opening member is provided and independent from the water outlet terminal, the raw water opening member controls the raw water inlet pipe to be opened or closed, and the raw water opening member and the purified water opening member are independent from each other.

15. The water outlet terminal with the purified water outlet according to claim 14, comprising:

a three-way valve, wherein:

the three-way valve comprises a raw water interface and a purified water interface, an inner side of the three-way valve comprises the raw water inlet cavity and the purified water inlet cavity, two ends of the raw water inlet cavity are respectively connected to the raw water interface and the raw water inlet pipe and two ends of the purified water inlet cavity are respectively connected to the purified water interface and the purified water inlet pipe.

16. The water outlet terminal with the purified water outlet according to claim 1, wherein:

a second side of the mandrel away from the raw water inlet cavity and the purified water inlet cavity comprises a first installation hole for installing a raw water switching member, the raw water switching member comprises a key and a first switching shaft, the first switching shaft is disposed between the raw water inlet cavity and the raw water outlet hole through the first installation hole, the mandrel further comprises a second installation hole disposed on the same side of the mandrel as the first installation hole, the purified water opening member comprises a button and a second switching shaft, and the second switching shaft is disposed between the purified water inlet hole and the purified water inlet cavity through the second installation hole.

17. The water outlet terminal with the purified water outlet according to claim 1, wherein the purified water opening member is disposed between the raw water inlet cavity and the purified water inlet cavity.

18. The water outlet terminal with the purified water outlet according to claim 1, wherein the purified water inlet cavity is disposed between the purified water opening member and the purified water outlet hole along the direction of flowing water.

19. The water outlet terminal with the purified water outlet according to claim 3, wherein the second side of the purified water inlet cavity lies in a plane perpendicular to the first side of the purified water inlet cavity.

20. The water outlet terminal with the purified water outlet according to claim 1, wherein the first opening and the second opening face a direction perpendicular to the cover assembly.

* * * * *